US006647566B1

(12) United States Patent
Wang

(10) Patent No.: US 6,647,566 B1
(45) Date of Patent: Nov. 18, 2003

(54) AUTOMATIC BATH ADDITIVE FEEDER

(76) Inventor: Sheng-Cheng Wang, 4F-1, No. 179, Ta-Yeh Rd., Nan-Tun Dist., Taichung City (TW)

( * ) Notice: Subject to any disclaimer, the term of this patent is extended or adjusted under 35 U.S.C. 154(b) by 0 days.

(21) Appl. No.: 10/283,461

(22) Filed: Oct. 30, 2002

(30) Foreign Application Priority Data

Aug. 8, 2002 (TW) ..... 91212285 U

(51) Int. Cl.[7] ..... A47K 3/28; B05B 7/26
(52) U.S. Cl. ..... 4/615; 4/903; 239/310
(58) Field of Search ..... 4/605, 615, 675, 4/903; 222/147.5; 141/348; 239/302, 307, 314, 318, 310

(56) References Cited

U.S. PATENT DOCUMENTS 2,624,619 A * 1/1953 Fletcher et al. ..... 239/310
3,386,808 A * 6/1968 Handeland ..... 210/198.1
4,281,796 A * 8/1981 Fugent et al. ..... 239/310
4,650,470 A * 3/1987 Epstein ..... 604/149
6,421,847 B2 * 7/2002 Berke et al. ..... 4/615

* cited by examiner

*Primary Examiner*—Charles E. Phillips
(74) *Attorney, Agent, or Firm*—Ladas & Parry

(57) ABSTRACT

An automatic bath additive feeder includes an additive container confining an inner space, and a valve unit mounted on the container. The valve unit includes a valve body formed with a valve opening and confining a valve chamber that is in fluid communication with the inner space through the valve opening, a valve disk for controlling opening and closing of the valve opening, and a partition dividing the valve chamber into first and second chamber halves. A channel is formed between the first and second chamber halves so as to branch a liquid flow to the inner space through the valve opening.

6 Claims, 6 Drawing Sheets

AUTOMATIC BATH ADDITIVE FEEDER

CROSS-REFERENCE TO RELATED APPLICATION

This application claims priority of Taiwanese Application No. 091212285, filed on Aug. 8, 2002.

BACKGROUND OF THE INVENTION

1. Field of the Invention

This invention relates to an automatic bath additive feeder, more particularly to an automatic bath additive feeder with a valve unit that permits branching of a liquid flow to an additive container.

2. Description of the Related Art

Hydrotherapy normally involves adding additives, such as mineral salts, into a water body in a bathtub or a spa pool. Conventionally, the additives can be directly dissolved in the water body or can be placed in a bag prior to immersion in the water body. Since the water body must be drained from the bathtub or the spa pool after hydrotherapy, both ways of adding the additives into the water body can result in waste of the additives.

SUMMARY OF THE INVENTION

The object of the present invention is to provide an automatic bath additive feeder that is capable of controlling the adding rate of the additives into the water body so as to overcome the aforesaid drawback of the prior art.

According to the present invention, an automatic bath additive feeder comprises: an additive container confining an inner space that is adapted to receive an additive bag therein, and having a top open end; and a valve unit. The valve unit includes a valve body that has a bottom wall mounted on and covering sealingly the top open end of the additive container and formed with first and second valve openings which are in fluid communication with the inner space. The valve body further has an annular flange extending transversely from the bottom wall and formed with an inlet adjacent to the first valve opening and an outlet adjacent to the second valve opening. The annular flange has a top open end, and confines a valve chamber that is in fluid communication with the inlet, the outlet, and the first and second valve openings. The inlet is adapted to be connected to a liquid supply for passage of a liquid flow therethrough. A rotating part is mounted on and covers sealingly the top open end of the annular flange. The rotating part includes a valve disk that is disposed in the valve chamber, that is seated rotatably on the bottom wall of the valve body, and that is formed with a first hole corresponding to the first valve opening and a second hole corresponding to the second valve opening. The valve disk is rotatable between an opened position, in which, the first and second holes are respectively registered with the first and second valve openings, thereby permitting fluid communication between the valve chamber and the inner space through the first and second valve openings, and a closed position, in which, the first and second valve openings are respectively offset from the first and second holes and are blocked by the valve disk, thereby preventing fluid communication between the valve chamber and the inner space. A partitioning plate is mounted securely in the valve chamber, is disposed between the first and second holes, and extends in a transverse direction relative to the valve disk so as to divide the valve chamber into a first chamber half that is in fluid communication with the inlet and the first hole, and a second chamber half that is in fluid communication with the outlet and the second hole. The valve unit is formed with a channel between the first and second chamber halves such that the liquid flow entering into the first chamber half through the inlet is divided into a main stream that flows from the first chamber half through the channel and into the second chamber half, and a branched stream that flows from the first chamber half through the first hole and the first valve opening and into the inner space and that further flows from the inner space through the second valve opening and the second hole and into the second chamber half when the valve disk is rotated to the opened position, thereby permitting transport of the additive into the second chamber half and discharging of the liquid flow together with the additive from the outlet.

BRIEF DESCRIPTION OF THE DRAWINGS

In drawings which illustrate embodiments of the invention.

DETAILED DESCRIPTION OF THE PREFERRED EMBODIMENTS

Figure 1:
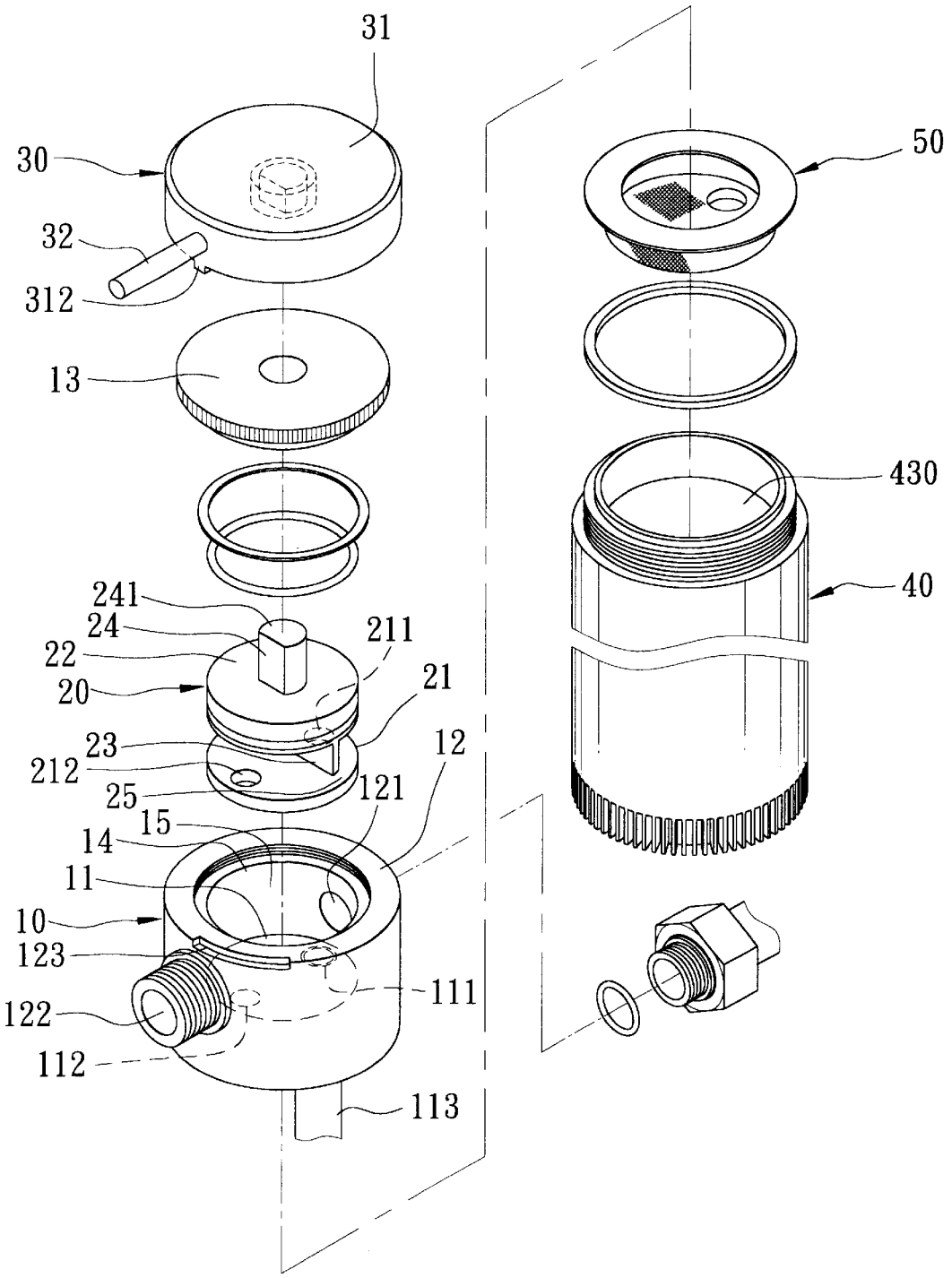
FIG. 1 is an exploded perspective view of a first preferred embodiment of an automatic bath additive feeder according to this invention.

For the sake of brevity, like elements are denoted by the same reference numerals throughout the disclosure.

FIGS. 1 to 4 illustrate a first preferred embodiment of an automatic bath additive feeder according to the present invention.

The automatic bath additive feeder includes: an additive container 40 confining an inner space 43 that is adapted to receive an additive bag 300 therein, and having a top open end 430; and a valve unit. The valve unit includes a valve body 10 that has a bottom wall 11 mounted on and covering sealingly the top open end 430 of the additive container 40 and formed with opposing first and second valve openings 111, 112 which are in fluid communication with the inner space 43. The valve body 10 further has an annular flange 12 extending transversely from the bottom wall 11 and formed with an inlet 121 adjacent to the first valve opening 111 and an outlet 122 opposite to the inlet 121 and adjacent to the second valve opening 112. The annular flange 12 has a top open end 14, and confines a valve chamber 15 that is in fluid communication with the inlet 121, the outlet 122, and the first and second valve openings 111, 112. The inlet 122 is adapted to be connected to a liquid supply (e.g. a tap water line with a tap 100 shown in FIG. 5) for passage of a liquid flow therethrough. A rotating part 20 is mounted on and covers sealingly the top open end 14 of the annular flange 12. The rotating part 20 includes a valve disk 21 that is disposed in the valve chamber 15, that is seated rotatably on the bottom wall 11 of the valve body 10, and that is formed with a first hole 211 corresponding to the first valve opening 111 and a second hole 212 corresponding to the second valve opening 112. The valve disk 21 is rotatable between an opened position (see FIG. 3), in which, the first and second holes 211, 212 are respectively registered with the first and second valve openings 111, 112, thereby permitting fluid communication between the valve chamber 15 and the inner space 43 through the first and second valve openings 111, 112, and a closed position (see FIG. 4), in which, the first and second valve openings 111, 112 are respectively offset from the first and second holes 211, 212 and are blocked by the valve disk 21, thereby preventing fluid communication between the valve chamber 43 and the inner space 15. A partitioning plate 23 is mounted securely in the valve chamber 15, is disposed between the first and second holes 211, 212, and extends in a transverse direction relative to the valve disk 21 so as to divide the valve chamber 15 into a first chamber half 151 that is in fluid communication with the inlet 121 and the first hole 211, and a second chamber half 152 that is in fluid communication with the outlet 122 and the second hole 212. The valve unit is formed with a channel 25 between the first and second chamber halves 151, 152 such that the liquid flow entering into the first chamber half 151 through the inlet 121 is divided into a main stream that flows from the first chamber half 151 through the channel 25 and into the second chamber half 152, and a branched stream that flows from the first chamber half 151 through the first hole 211 and the first valve opening 111 and into the inner space 43 and that further flows from the inner space 43 through the second valve opening 112 and the second hole 212 and into the second chamber half 152 when the valve disk 21 is rotated to the opened position, thereby permitting transport of the additive into the second chamber half 152 and discharging of the liquid flow together with the additive from the outlet 122.

The rotating part 20 further includes an annular top wall 22 opposite to the valve disk 21, and a seal ring 26 disposed between the annular flange 12 and the top wall 22 so as to provide a sealing effect therebetween. The partitioning plate 23 interconnects the valve disk 21 and the top wall 22, and has two opposite sides that are spaced apart from the annular flange 12 to define the channel 25.

The valve body 10 further includes a cover 13 that is mounted securely on the top open end 14 of the annular flange 12 above the top wall 22 of the rotating part 20. The rotating part 20 further includes a stem 24 extending outwardly from the top wall 22 through the cover 13 and having a top end 241. The valve unit further includes an operating lever 32 that is connected to the top end 241 of the stem 24 via an annular member 31 for rotating the valve disk 21.

The valve body 10 further includes a tube 113 extending downwardly from a periphery of the first valve opening 111 into the inner space 43 so as to guide the liquid flow to flow over the additive bag 300. A screen filter 50 is disposed underneath the bottom wall 11 of the valve body 10 such that the branched stream passes through the screen filter 50 when flowing from the first chamber half 151 to the second chamber half 152.

The top open end 14 of the annular flange 12 of the valve body 10 is formed with an arcuate recess 123. The annular member 31 covers the top open end 14 of the annular flange 12, and is formed with a tongue 312 that projects therefrom into the arcuate recess 123 so as to limit the rotation of the valve disk 21 within the length of the arcuate recess 123.

Figure 5:
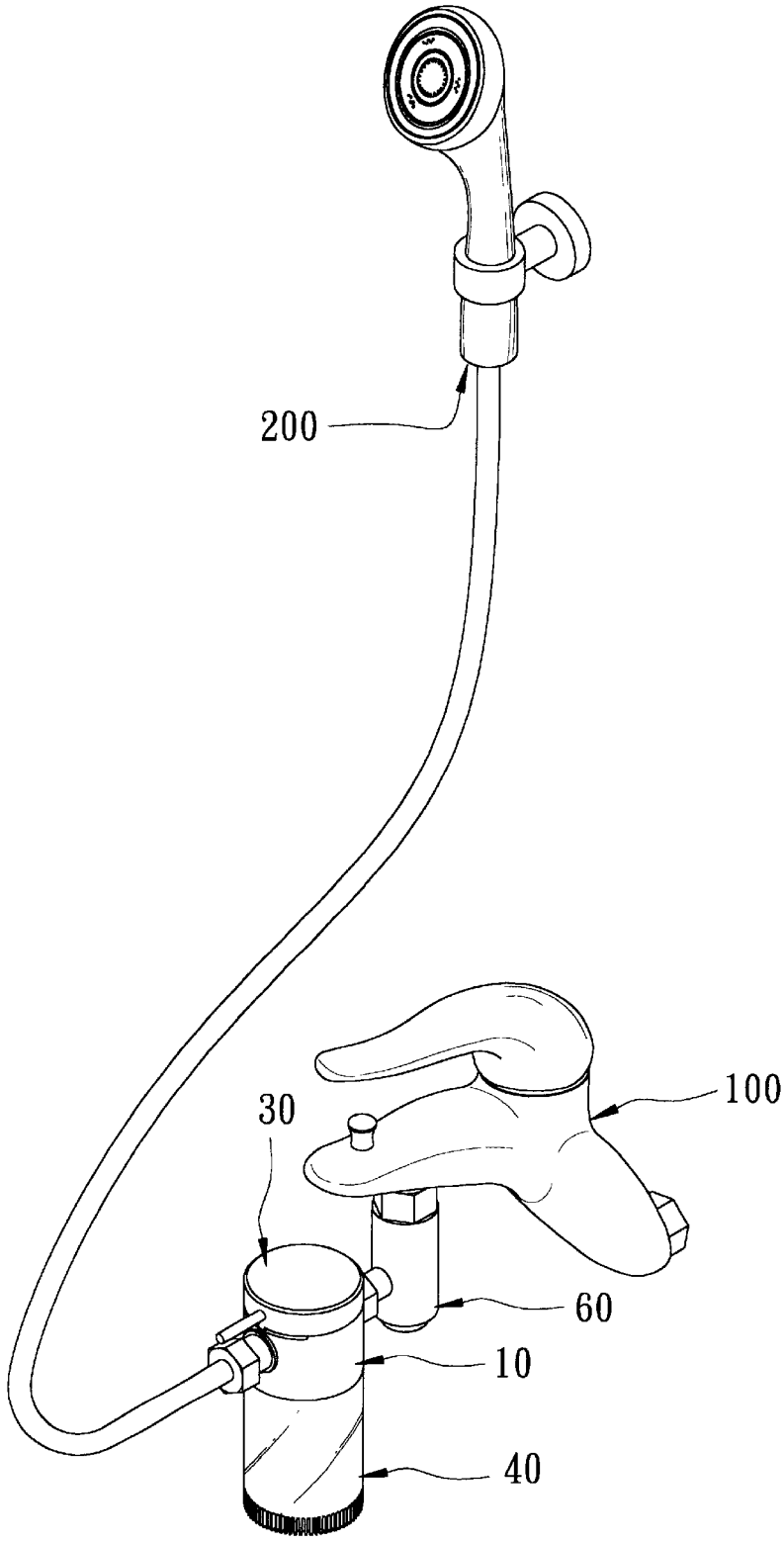
FIG. 5 is a perspective view illustrating how the automatic bath additive feeder of FIG. 1 is connected to a shower hose upstream of a shower head.

Referring now to FIG. 5, the automatic bath additive feeder can be connected to the tap 100 of the tap water line via a connector 60 and to a shower hose with a shower head 200.

Figure 2:
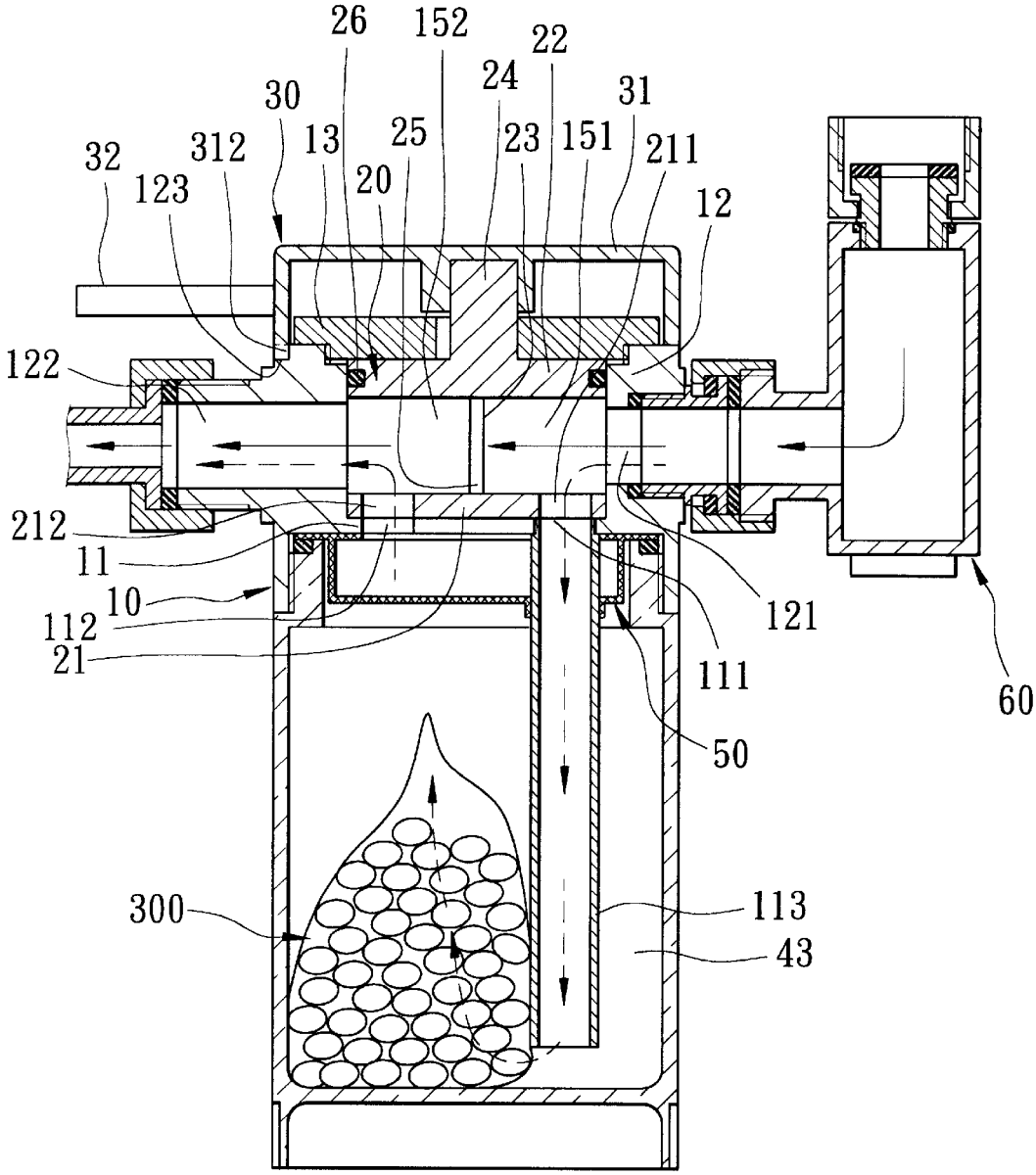
FIG. 2 is a sectional view of the automatic bath additive feeder of FIG. 1.
Figure 3:
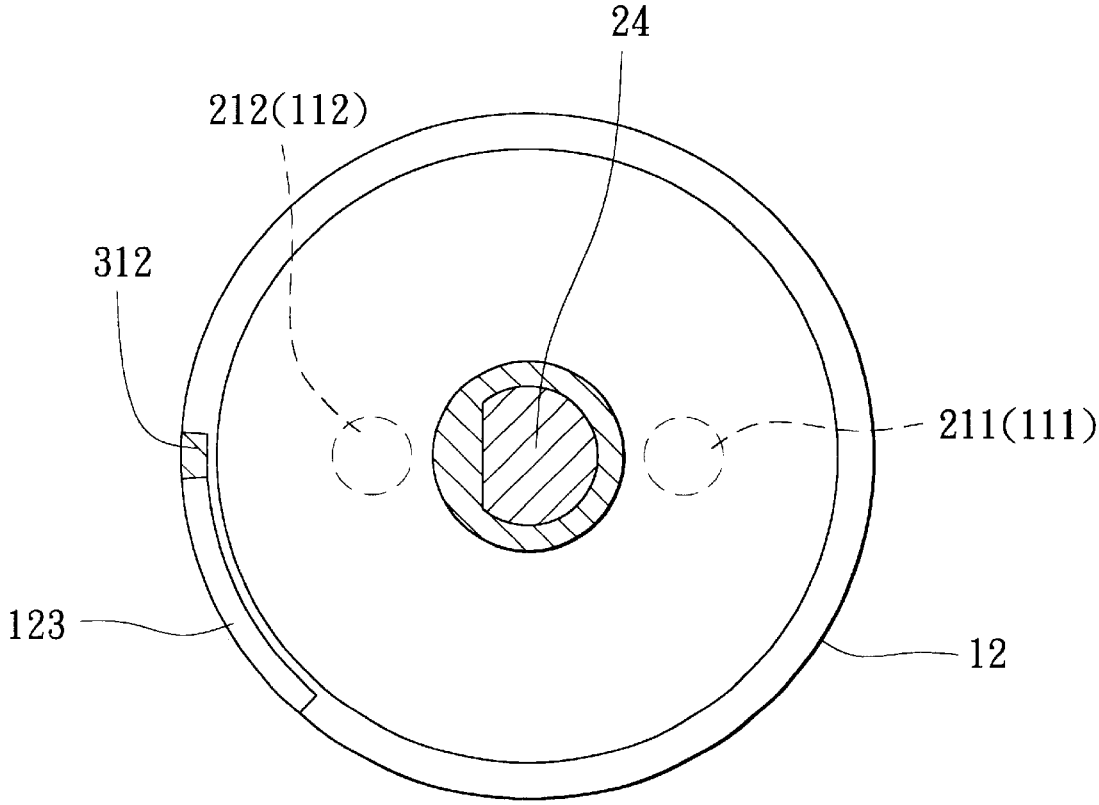
FIG. 3 is a fragmentary top sectional view illustrating how a valve disk of a valve unit of the automatic bath additive feeder of FIG. 1 is rotated to an opened position.
Figure 4:
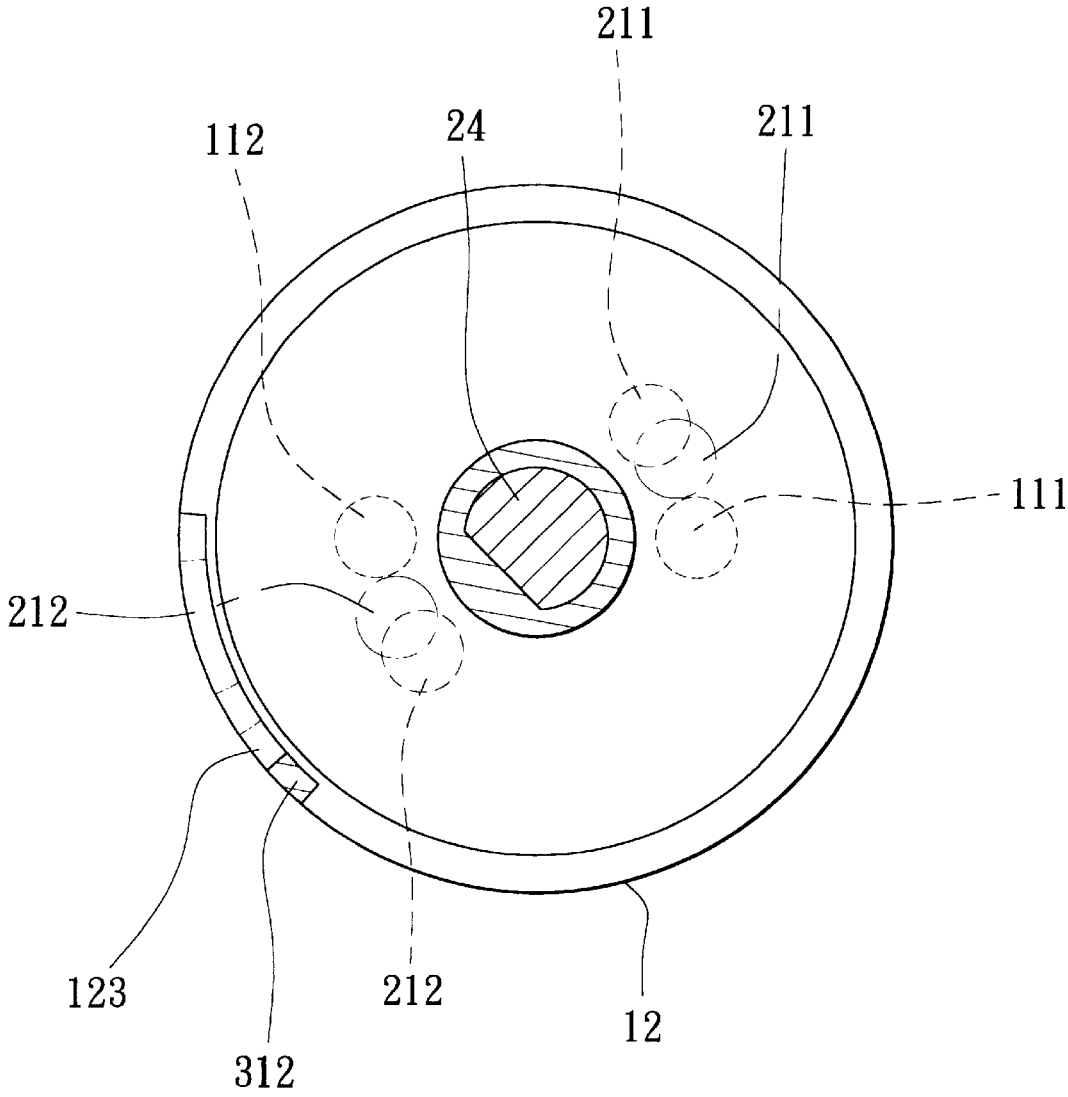
FIG. 4 is a fragmentary top sectional view illustrating how the valve disk of the valve unit of the automatic bath additive feeder of FIG. 1 is rotated to a closed position.
Figure 6:
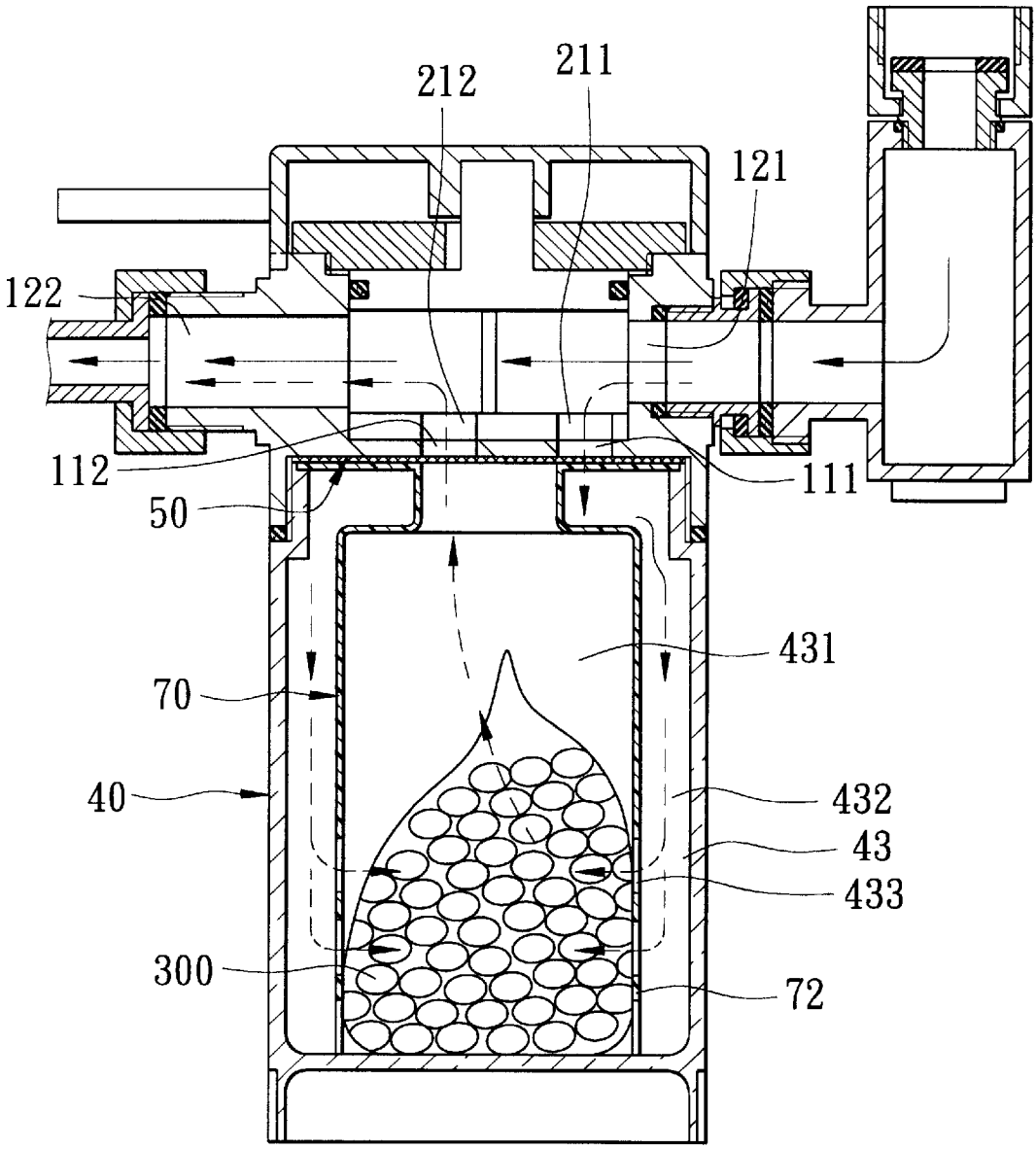
FIG. 6 is a sectional view of a second preferred embodiment of the automatic bath additive feeder according to this invention.

FIG. 6 illustrates a second preferred embodiment of the automatic bath additive feeder of this invention, which is similar to the previous embodiment shown in FIG. 2, except that an inner partition 70 is used instead of the tube 113 in the previous embodiment to guide the liquid flow to flow over the additive bag 300. The inner partition 70 divides the inner space 43 into an inner chamber 431 which is adapted to receive the additive bag 300 therein and which is in fluid communication with the second valve opening 112, and an outer chamber 432 which surrounds the inner chamber 431 and which is in fluid communication with the first valve opening 111. The inner partition 70 has a lower end 72 that is opposite to the top open end 430 of the additive container 43 and that is formed with at least a through-hole 433 which is in fluid communication with the inner and outer chambers 431, 432 so as to guide the liquid flow to flow over the additive bag 300.

By adjusting the angular position of the valve disk 21 between the opened and closed positions, the releasing rate of the additive in the additive bag 300 into the liquid flow can be controlled according to the user's requirement, thereby eliminating the drawback as encountered in the prior art.

With the invention thus explained, it is apparent that various modifications and variations can be made without departing from the spirit of the present invention. It is therefore intended that the invention be limited only as recited in the appended claims.

I claim:

1. An automatic bath additive feeder comprising:

an additive container confining an inner space that is adapted to receive an additive bag therein, and having a top open end; and a valve unit including a valve body that has a bottom wall mounted on and covering sealingly said top open end of said additive container and formed with first and second valve openings which are in fluid communication with said inner space, said valve body further having an annular flange extending transversely from said bottom wall and formed with an inlet adjacent to said first valve opening and an outlet adjacent to said second valve opening, said annular flange having a top open end and confining a valve chamber that is in fluid communication with said inlet, said outlet, and said first and second valve openings, said inlet being adapted to be connected to a liquid supply for passage of a liquid flow therethrough, a rotating part mounted on and covering sealingly said top open end of said annular flange, said rotating part including a valve disk disposed in said valve chamber, seated rotatably on said bottom wall of said valve body, and formed with a first hole corresponding to said first valve opening and a second hole corresponding to said second valve opening, said valve disk being rotatable between an opened position, in which, said first and second holes are respectively registered with said first and second valve openings, thereby permitting fluid communication between said valve chamber and said inner space through said first and second valve openings, and a closed position, in which, said first and second valve openings are respectively offset from said first and second holes and are blocked by said valve disk, thereby preventing fluid communication between said valve chamber and said inner space, and a partitioning plate mounted securely in said valve chamber, disposed between said first and second holes, and extending in a transverse direction relative to said valve disk so as to divide said valve chamber into a first chamber half that is in fluid communication with said inlet and said first hole, and a second chamber half that is in fluid communication with said outlet and said second hole;

wherein said valve unit is formed with a channel between said first and second chamber halves such that the liquid flow entering into said first chamber half through said inlet is divided into a main stream that flows from said first chamber half through said channel and into said second chamber half and a branched stream that flows from said first chamber half through said first hole and said first valve opening and into said inner space and that further flows from said inner space through said second valve opening and said second hole and into said second chamber half when said valve disk is rotated to said opened position, thereby permitting transport of the additive into said second chamber half and discharging of the liquid flow together with the additive from said outlet.

2. The automatic bath additive feeder of claim 1, wherein said rotating part further includes an annular top wall opposite to said valve disk, and a seal ring disposed between said annular flange and said top wall, said partitioning plate interconnecting said valve disk and said top wall and having two opposite sides that are spaced apart from said annular flange to define said channel.

3. The automatic bath additive feeder of claim 2, wherein said valve body further includes a cover that is mounted securely on said top open end of said annular flange above said top wall of said rotating part, said rotating part further including a stem extending outwardly from said top wall through said cover and having a top end, said valve unit further including an operating lever that is connected to said top end of said stem for rotating said valve disk.

4. The automatic bath additive feeder of claim 1, wherein said valve body further includes a tube extending downwardly from a periphery of said first valve opening into said inner space.

5. The automatic bath additive feeder of claim 1, wherein said additive container includes an inner partition that divides said inner space into an inner chamber which is adapted to receive the additive bag therein and which is in fluid communication with said second valve opening, and an outer chamber which surrounds said inner chamber and which is in fluid communication with said first valve opening, said inner partition having a lower end that is opposite to said top open end of said additive container and that is formed with at least a through-hole which is in fluid communication with said inner and outer chambers.

6. The automatic bath additive feeder of claim 1, further comprising a screen filter disposed underneath said bottom wall of said valve body such that said branched stream passes through said screen filter when flowing from said first chamber half to said second chamber half.

* * * * *